United States Patent [19]

Meyer et al.

[11] Patent Number: 4,603,562

[45] Date of Patent: Aug. 5, 1986

[54] BOBBIN SUPPORTING TEXTILE STRANDS TO BE SUBJECTED TO A HEAT AND/OR WET TREATMENT

[75] Inventors: Hans Meyer; Viggo E. Hartmann, both of Silkeborg, Denmark

[73] Assignee: A/S Kaj Neckelmann, Syntetisk Fiber Industri, Silkeborg, Denmark

[21] Appl. No.: 645,284

[22] Filed: Aug. 29, 1984

[30] Foreign Application Priority Data

Sep. 13, 1983 [DK] Denmark ..... 4161/83

[51] Int. Cl.[4] ..... B65H 75/20; D06B 5/18

[52] U.S. Cl. ..... 68/198; 242/118.11

[58] Field of Search ..... 68/198; 242/118.1, 118.11, 242/118.2

[56] References Cited

U.S. PATENT DOCUMENTS

| | | | |
|---|---|---|---|
| 2,614,764 | 10/1952 | Annicq | 242/118.11 |
| 2,818,222 | 12/1957 | Scholl | 242/118.11 |

FOREIGN PATENT DOCUMENTS

| | | | |
|---|---|---|---|
| 75931 | 6/1953 | Denmark . | |
| 926066 | 9/1954 | Fed. Rep. of Germany . | |
| 694815 | 7/1953 | United Kingdom | 242/118.11 |
| 1137609 | 12/1968 | United Kingdom . | |
| 1363363 | 8/1974 | United Kingdom . | |

*Primary Examiner*—Philip R. Coe

*Attorney, Agent, or Firm*—Oblon, Fisher, Spivak, McClelland & Maier

[57] ABSTRACT

A cylindrical or conical bobbin (1) resiliently compressible both in axial and in radial direction and supporting textile strands to be subjected to a heat and/or wet treatment has an outer grating (3), the outer side of which forms the curved surface of the bobbin (1), the curved surface serving as a supporting surface for the strands. The bobbin (1) includes means (2, 2', 2'', 3, 4, 5) which retain the grating (3) when the bobbin (1) is not compressed more than a predetermined length in the axial direction in such a manner that the outer surface is positioned in a radial outer position, and which release the grating (3) when the bobbin (1) is axially compressed more than a predetermined length in such a manner that the outer surface is inwardly displaceable into a radial inner position, and which prevent an additional inward displacement of the outer surface.

As a result, the bobbin (1) can maintain a constant maximum outer diameter during the winding of the strands on the bobbin and during the later handling thereof, and through a suitable, axial compression of the bobbin (1) a reduction of the outer diameter of said bobbin is obtainable in such a manner that the strands wound thereon may relax in their longitudinal direction.

14 Claims, 8 Drawing Figures

BOBBIN SUPPORTING TEXTILE STRANDS TO BE SUBJECTED TO A HEAT AND/OR WET TREATMENT

BACKGROUND OF THE INVENTION

The invention relates to a bobbin supporting textile strands, especially synthetic, textured filament yarns to be subjected to a heat and/or wet treatment, the bobbin having an outer, cylindrical or slightly conical grating, the outer side of which forms the curved outer surface of the bobbin serving as a supporting surface for the strands or for a resilient support for the strands, and whereby the bobbin is resiliently compressible both in the axial and in the radial direction.

Several processes, whereby textile strands wound on bobbins are treated, necessitate the possibility of allowing the strands to relax and shrink. This feature applies especially to heat and/or wet treatments of synthetic, textured filament yarns, e.g. at heat shrinking and at dyeing of said yarns. Such processes are in general carried out with the yarns wound on particular shrinking bobbins which simultaneously must be both axially and radially compressible.

Several bobbins of thermoplastic material are known which are compressible in the axial and radial directions, but these bobbins are all encumbered with the draw-back that with heat and/or wet treatments they undergo a plastic deformation, which in practice implies that they are only suitable for a single or a few uses, which makes them much too expensive to use.

In addition, bobbins of plastics are known, which are axially and radially compressible, but which require the use of an inner carrying means such as a mandrel during the winding of the yarn in order to avoid axial and radial compressions during the winding.

Moreover for instance British patent specification No. 1,363,363 and U.S. Pat. No. 2,818,222 disclose axially compressible bobbins of steel. These bobbins have a core of a helical pressure spring surrounded by a helically positioned net or grating of windings and a grating of parallel, axially oriented ribs or lamellas. In both cases these ribs or lamellas can slide on the windings of the helical spring and on guide rings, respectively, during the axial compressions and resilient returning movements of the bobbins. None of these bobbins are, however, radially compressible.

British patent specification No. 1,363,363 discloses, however, also a bobbin of the type shown in the specification which is modified in such a manner that it is both axially and radially compressible. This axial and radial compression is allowed by the windings of lacing wire positioned about the windings of the helical spring being provided with a greating winding width measured in the radial direction of the bobbin so that the lacing windings are movable in and out in the radial direction of the bobbin about the windings of the helical spring. The grating of lacing wire inserted in this manner does possess a certain resilience ensuring that the grating is outwardly displaced on the bobbin in the non-wound state of the bobbin, whereby the inner lacing windings abut the inner side of the windings of the helical spring. The resilient tensions in the lacing wire ensuring this feature are, however, so insignificant that during the winding of yarn on the bobbin, a mandrel must be used inside the bobbin, said mandrel ensuring that the lacing wire is kept in its outer position. The latter procedure involves additional work and is more expensive. In addition, the removal of the mandrel upon termination of the winding implies that the lacing wire is pressed inwards again by the yarns in such a manner that during the further handling of the bobbins said yarns are too badly retained on the bobbins and sometimes slide off said bobbins. A need thus exists for amending these bobbins in such a manner that they can be used during and after the winding without a mandrel, but with an outwardly displaced lacing wire as long as it is desired.

SUMMARY OF THE INVENTION

The object of the present invention is to provide a bobbin of the above type which is both axially and radially resiliently compressible and to be used for a heat and/or wet treatment of yarns or textile strands, especially synthetic, textured filament yarns, and which is suited for winding machines without the use of mandrels, and which does not change its properties even after use for a long period.

The bobbin according to the invention includes means which with the bobbin axially uncompressed or almost uncompressed are securing the grating in such a manner that its outer surface is positioned in an outer position, and which with the bobbin axially compressed more than a predetermined length, e.g. more than 4 mm, are releasing the grating in such a manner that its outer surface is inwardly displaceable into a radial inner position, said means preventing a further displacement inwards of the outer surface. In this manner the bobbin can in practice be used for winding yarns on a winding machine, and the handling of the bobbins can be carried out without the use of a mandrel for pressing out the grating as said grating is maintained per se in the outer position. As a result, the yarns are reliably and permanently positioned on the bobbin without the risk of said yarns sliding thereon. An additional advantage is that the grating is displaceable inwards a predetermined distance when the bobbin is axially compressed in view of a shrinking of the yarns at a heat and/or wet treatment thereof, e.g. at dyeing. A particularly reliable and functional embodiment of the invention which is suited for use over and over again includes a helical spring defining biasing means and forming the carrying core of the bobbin and the shape and characteristics of which substantially determine the length, diameters, and axial compressibility of the bobbin, and whereby the grating has a continuous, flat, spirally coiled band such as a lacing formed by a wire and extending helically along the windings or turns of the helical spring in such a manner that it surrounds two succeeding windings or turns of the helical spring and further in such a manner that each winding of the helical spring—apart from the outermost end windings thereof—is alternately surrounded by a winding from each of the two adjacent courses of the lacing, and whereby the lacing biases the helical spring towards an axial compression and biases the outer windings of the helical spring further in such a manner that the outer windings of the bobbin form substantially planar end surfaces almost perpendicular to the axis of the bobbin, and whereby the greatest inner measurements of the profile of the lacing in the radial direction of the bobbin correspond to the outer axial measurements of two succeeding windings of the helical spring at the maximum axial length of the bobbin. This bobbin is characterised in that the connecting means securing the elements of the grating are the windings of the helical spring, and where the profile of each helical winding of the lacing—seen projected on a normal plane for the lacing—is a grating element and is substantially convex on the side facing outwards from the bobbin and is substantially planar or substantially convex with rounded corners and ends on the side facing the centre of the bobbin, the diameters of said rounded corners and ends at substantially corresponding to the diameter of the helical spring wire, and that the inner dimension of the lacing profile in axial direction from the outer side of the bobbin tapers off towards its two opposing ends in axial direction into a dimension only slightly greater, e.g. 0.5–1.0 mm greater than the radial thickness of the helical spring wire.

The turns of the lacing define elements of a substantially cylindrical grating having elongated slots. The axial ends of each of the slots are curved with a diameter substantially equal to the diamter of the connecting portion which may be the turns of the helical spring. Each slot has a radially outer surface defined by a radially outer portion of each turn of the lacing, the radially outer surface being directed outward from the curved ends so that an intermediate portion of the radially outer surface is positioned substantially radially outward of any straight line connecting the curved ends. The radially inner surface of each slot corresponds to a radially inner portion of each turn of the lacing and defines a straight line connecting radially inner ends of the curved ends of the slot.

According to some particularly advantageous embodiments, the profile of the individual spiral windings of the lacing—seen projected on a normal plane for the lacing—is substantially hexagonal, trapezoidal, elliptical, shaped as a segment of an ellipse or as a segment of a circle with rounded corners and ends with inner radii of curvature at least corresponding to the half radial thickness of the helical spring wire or is of a shape resulting from a combination of two or more of these shapes. The trapezoidal profile turned out to be particularly suitable as it provides a reliable and good function, and it is furthermore space-saving as it does not extend unnecessarily into the bobbin.

According to a particular embodiment of the bobbin according to the invention, it comprises a biasing force for the helical spring of about 2–3 kp, a maximum resilient axial compressibility of about 45% of its original bobbin length at a total pressure of about 5–7 kp and a resilient radial compressibility of between 1–20%, prefably 5–12%, especially 6–9% of the inner diameter of the bobbin.

According to another particular embodiment of the bobbin according to the invention, which is particularly suited for synthetic, textured filament yarns, and which is of a trapezoidal lacing profile, the helical spring is a hardened stainless steel spring of a diameter of 3–5 mm and with a winding distance of 20–30 mm and a spring diameter of 75–80 mm, and the wire grating is made of a stainless steel wire of a diameter of 0.8–1.2 mm with a trapezoidal lacing profile with 20–35 windings per helical spring winding, and whereby the acute angles of the trapezium are 30°–45° permitting a radial compression of about 5–8% of the spring diameter or about 4.5–6.4 mm upon an axial compression of about 20%.

Another advantageous embodiment of the bobbin according to the invention shows a cylindrical bobbin of the type comprising an inner core of a helical pressure spring, the ends of which abut two annular end parts, and whereby a grating of two sets of radially positioned lamellas with longitudinal slots extends around the helical spring, between the end parts and suspended in said end parts, which lamellas are of half the length of the bobbin and form a support for yarns and are mutually displaced in the peripheral direction of the bobbin and surround from each side at the centre of the bobbin a central ring extending about the helical spring and displaceable in the slots of the lamellas when the bobbin is axially compressed. This bobbin is characterised in that the means for securing the lamellas in a radial outer position when the bobbin is not axially compressed and a radial inner position, respectively, when the bobbin is axially and radially compressed, are formed by said central ring and two corresponding end rings secured on the underside of the end parts, and that the slots in the lamellas extend in almost the entire length of said lamellas and are trapezoidal with the short parallel side of the trapezium facing outwards from the centre of the bobbin, or are convex in another manner such as for instance stepped or combined stepped and trapezoidal, and whereby the lamellas are guided to the side in radially positioned gates in a plate in the end part, and whereby said lamellas are displaceable through said gates a distance axially inwards when the bobbin is axially compressed.

In this embodiment, the cylindrical spring constitutes biasing means while the connecting means are constituted by the end rings and the central ring. The lamellas form the grating elements of the grating.

An advantage of the above embodiment is that the end ring is secured to the end part by means of clamping means anchored in holes in the plate. A further advantage of this embodiment is that the outer annular rim of the end part is obliquely bevelled in such a manner that its underside may assist in pressing the lamella inwards at the axial compression of the bobbin.

BRIEF DESCRIPTION OF THE DRAWINGS

The invention will be described below with reference to the accompanying drawing, in which.

DETAILED DESCRIPTION OF THE PREFERRED EMBODIMENTS

Figure 1:
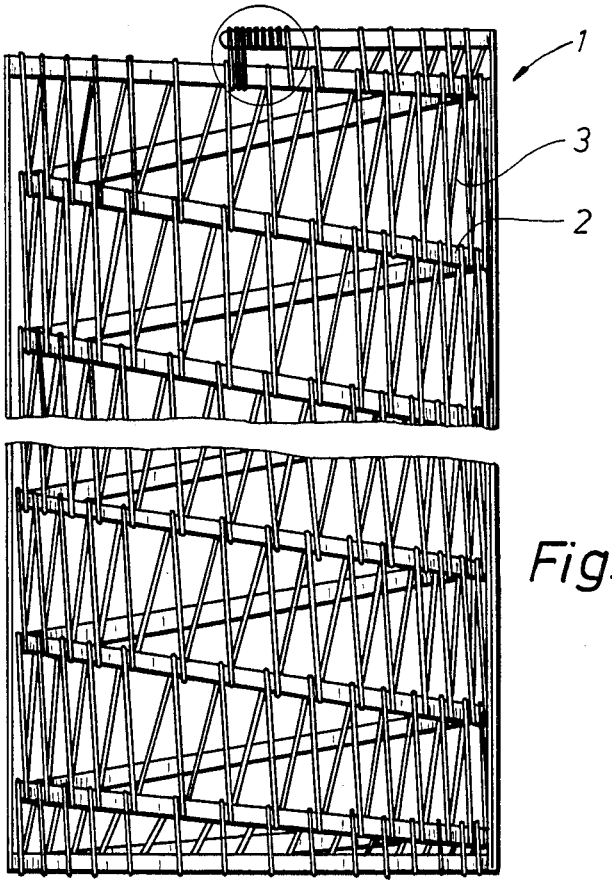
FIG. 1 illustrates the principal structure of a bobbin according to the invention with a core of a helical spring and a grating of lacing wire mounted on said helical spring.
Figure 4:
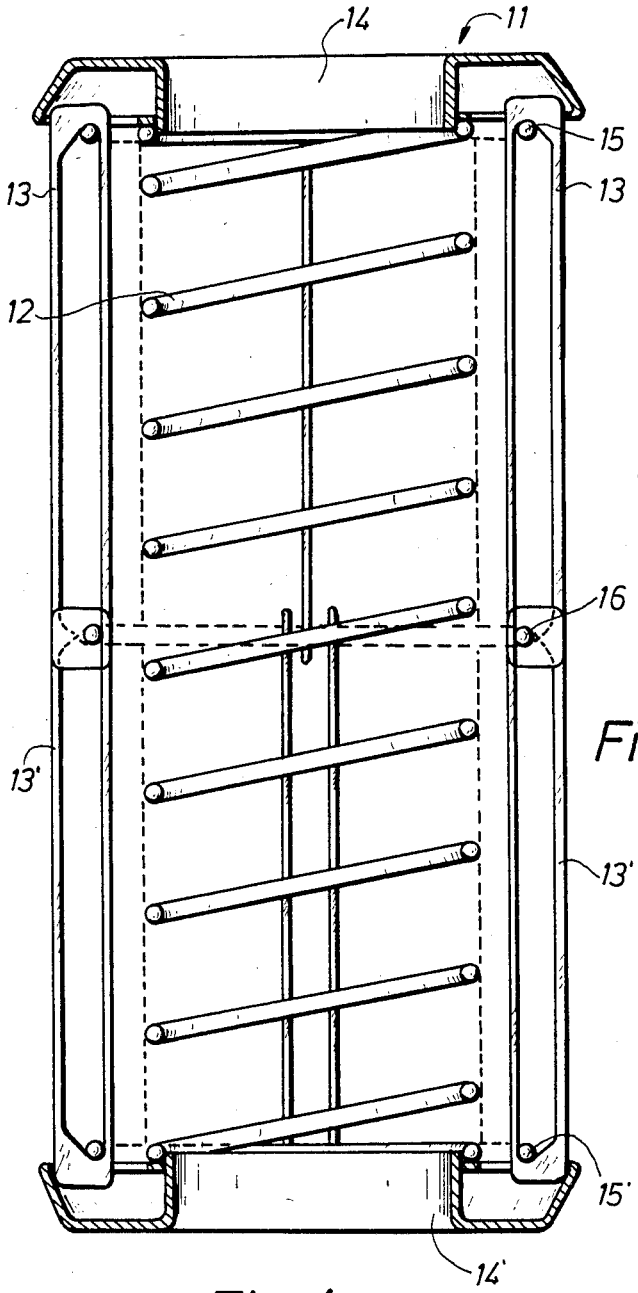
FIG. 4 illustrates a second embodiment of a bobbin according to the invention with a core of a helical spring and a grating of lamellas with end parts which are mounted around said grating, said lamellas being shown in the outer position.
Figure 5:
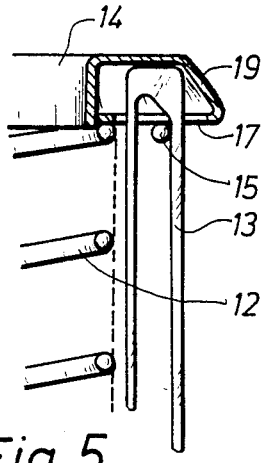
FIG. 5 is a sectional view of the bobbin, a lamella appearing in the inner position.
Figure 6:
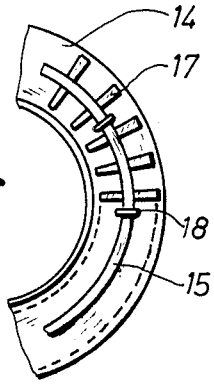
FIG. 6 is a sectional view of an end part with an end ring, seen in a direction away from the central ring.
Figure 7:
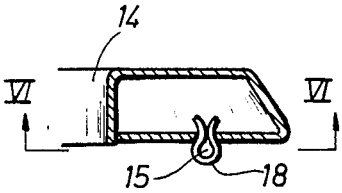
FIG. 7 is a sectional view of an end ring with a clamp.

FIG. 1 shows an outline of principle of a bobbin 1 comprising a core of a helical spring 2. A grating 3 of a lacing wire is mounted on the helical spring 2. The grating 3 is manufactured by the lacing wire being bent into a tubular flat spiral band of a length sufficient for covering the total curved surface of the helical spring, and whereby the individual windings of the spiral band are of a width fitting to the desired resulting winding distance on the helical spring 2, said width tapering off towards the ends of the spiral band. The bending may for instance be carried out by means of a bending tool including a turnable mandrel. The mandrel is provided with two optionally turnable pins projecting axially outwards from one end surface of said mandrel. One of these pins is cylindrical, coaxial to the mandrel, and furthermore of a diameter corresponding to twice the inner radius of curvature of the rounded corners and ends of the completed spiral band. The other pin is preferably of a greater diameter and optionally radially displaceable relative to the mandrel. The space between the surfaces of the pins is adjustable relative to the thickness of the lacing wire used in such a manner that said wire without difficulties is displaceable through said space. Subsequently, the bending is carried out by advancing the lacing wire stepwise in the space between the two pins under an angle with the axis of the mandrel determined by the rise desired from winding to winding in the spiral band, whereafter bendings are carried out according to predetermined advancing lengths by turning the mandrel a predetermined angle in such a manner that the lacing wire advanced through the space is bent said angular length between the two pins. In this manner the spiral band is produced through a successive advancing and bending of the lacing wire. The individual steps and the combination thereof are electronically controllable, e.g. by numeric control. The spiral band is mounted on the helical spring 2 by being pulled on the windings of the helical spring and by the ends of the lacing being fastened as illustrated in details in FIG. 1.

Figure 1A:
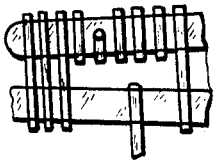
FIG. 1A is a detail of the circled portion of FIG. 1.
Figure 3:
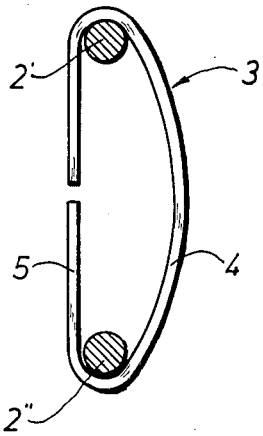
FIG. 3 illustrates a profile of a single winding of a lacing wire shaped as a segment of a circle.
Figure 2:
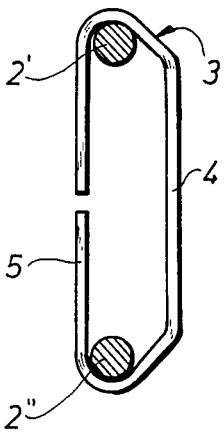
FIG. 2 illustrates a profile of a single trapezoidal winding of a lacing wire.

FIGS. 2 and 3 illustrate examples of the profile of the individual windings in the lacing wire with convex outer sides. These outer sides can either be trapezoidal, cf. FIG. 2, with the short parallel side 4 of the trapezium facing outwards on the bobbin 1 or be shaped as a segment of a circle, cf. FIG. 3, with the curved side 4 facing outwards on the bobbin, whereas the innermost winding lengths 5 are planar. It is evident that when the helical spring is in the stretched out position shown in FIGS. 2 and 3, said spring forces the grating 3 into an outer position on the bobbin 1 with the planar inner winding lengths 5 tightly abutting the helical spring 2. On the other hand, when the helical spring 2 is axially compressed in such a manner that the two windings 2', 2'' of FIGS. 2 and 3 approach each other, the grating 3 may be pressed inwards on the bobbin 1 until the outer convex sides 4 of the grating 3 abut the windings 2', 2'' of the helical spring, whereby the bobbin 1 takes up its minimum diameter. When the axial compression of the bobbin 1 is terminated, the helical spring 2 moves again into the position of FIGS. 2 and 3 and forces the grating 3 outwards into the outer position again, provided said grating is not retained in another manner.

FIGS. 4 to 7 illustrate another embodiment of a bobbin 11 according to the invention. This bobbin comprises likewise a helical spring 12, the end windings of which abut two end parts 14, 14'. The bobbin 11 is maintained biased by means of two sets of outer lamellas 13, 13' guided and retained by two end rings 15, 15' and a central ring 16. The end rings are secured on the end parts 14, 14' by means of clamps 18 of any known art. The lamellas 13, 13' of the two sets are mutually displaced in the peripheral direction of the bobbin 11. Each lamella has a longitudinal trapezoidal recess, the short parallel side of which faces outwards from the bobbin and through which the end ring 15, 15' and the central ring 16 are also extending. The end rings 15, 15' are secured on the end parts 14, 14' coaxially with the helical spring 12, whereas the central ring 16 is loosely situated in the recesses of the two sets of lamellas 13, 13'. The lamellas 13, 13' are guided laterally in gates 17 in a bottom plate in the end parts 14, 14' and they are movable both in axial and in radial direction in said gates. When the bobbin 11 is not loaded or only slightly loaded in the axial direction, the helical spring 12 keeps the end parts 14, 14' and consequently the end rings 15, 15' and the lamellas 13, 13' stretched out in the position shown in FIG. 4 in such a manner that the sets of lamellas 13, 13' are pressed outwards into an outer position with the greatest possible outer diameter for the bobbin 11. When the bobbin 11 is axially compressed, the lamellas 13, 13' can enter the position of FIG. 5 as a consequence of a radial pressure from the outside and furthermore a corresponding inwardly displaced position at the central ring 16 in such a manner that the outer diameter of the bobbin is reduced. The extent of the diameter reduction is determined by the width of the recesses in the lamellas 13 and by the diameter of the end rings 15, 15' and the central ring 16. The inward displacement of the lamellas 13, 13' at the axial compression of the bobbin 11 can be further ensured by means of an inclined bevelling of the outer annular rim 19 of the end parts, the underside of said rim thereby assisting in pressing the lamella inwards at the axial compression of the bobbin. The end parts 14, 14' can be completely or partially pulled into shape from a metal plate in which the gates 17 and the holes for the clamps 18 are punched out, or the end parts may be cast in one piece. The lamellas 13, 13' may be made of sheet material or be bent into the desired shape of metal wire or be cast. The material used for the bobbins is preferably stainless steel and stainless spring steel for the helical spring, but the lamellas and the end parts may for instance also be made of plastics.

We claim:

1. A bobbin for supporting textile strands, comprising:

means defining a substantially cylindrical grating, said grating comprising a plurality of grating elements, each of said grating elements defining a slot elongated in the direction of the axis of said cylinder, each said slot having axial ends which are curved with a first diameter, each said slot having a radially outer surface connecting said curved ends, at least a portion of said radially outer surface being directed outward from said curved ends so that an intermediate portion of said outer surface is positioned substantially radially outward of any straight line connecting said curved ends;

connecting means, at least two of said connecting means passing through each of said slots, said connecting means being curved in section with a diameter substantially equal to said first diameter; and means for biasing said at least two connecting means away from one another in the axial direction, whereby when said connecting means are biased to said axial ends, said intermediate portion assumes a position radially outward from said connecting means.

2. The bobbin of claim 1 wherein a radially inner surface of said slot defines a straight line connecting radially inner ends of said curved ends.

3. A bobbin as claimed in claim 2 wherein said connecting means comprise turns of a helical spring forming said means for biasing and forming a carrying core of the bobbin, the shape and characteristics of said spring substantially determining the length, diameter, and axially compressibility of the bobbin, and whereby the grating comprises a continuous flat sprirally coiled band formed by a wire lacing and extending helically along the turns of the helical spring in such a manner that said lacing surrounds two succeeding turns of the helical spring and in such a manner that each turn of the helical spring, apart from the outermost end windings thereof, is alternately surrounded by a turn from each of the two adjacent courses of the lacing, each said lacing turn defining one of said grating elements, and whereby the lacing biases the helical spring towards an axial compression and biases the outer turns of the helical spring further in such a manner that the outer turns of the bobbin form substantially planar end surfaces almost perpendicular to the axis of the bobbin, and whereby the greatest inner measurements of the profile of the lacing in the radial direction of the bobbin correspond to the outer axial measurements of two succeeding turns of the helical spring at the maximum axial length of the bobbin.

4. A cylindrical bobbin as claimed in claim 2 including an inner core of a helical pressure spring defining said biasing means, the ends of which abut two annular end parts, including two sets of radially positioned lamellas arranged around the helical spring to define said grating elements, said lamellas positioned between the ends parts and suspended in said end parts, wherein said lamellas are of half the length of the bobbin and form a support for yarns and are mutually displaced in the circumferential direction of the bobbin and surround from each side at the centre of the bobbin a central ring extending about the helical spring and displaceable in the slots of the lamellas when the bobbin is axially compressed, wherein said connecting means comprise said central ring and two corresponding end rings secured on the underside of each of the end parts, and wherein said slots in the lamellas extend by almost the entire length of said lamellas.

5. A bobbin as claimed in claim 4, wherein each said end ring is secured to the end part by means of clamping means anchored in holes in said end ring.

6. A bobbin as claimed in claim 4, wherein an outer annular rim of each end part is obliquely bevelled in such a manner that its underside may assist in pressing the lamellas inwards upon the axial compression of the bobbin.

7. A bobbin as claimed in one of the preceding claims 4 to 6, wherein inward displacement of said bobbin is carried out by the lamellas being turned during the axial compression of the bobbin, said lamellas turning about turning axes of said lamellas, said turning axes extending parallel to the longitudinal axis of the bobbin and through the individual lamellas.

8. A bobbin as claimed in claim 7 wherein the turning of the individual lamellas is produced through an interaction of engaging surfaces shaped on the end parts and the lamellas.

9. The bobbin of claim 3 or 4 wherein said outer surface of said slot corresponds in shape to that of a radially outer portion of each said lacing turn and is substantially hexagonal.

10. The bobbin of claim 3 or 4 wherein said outer surface of said slot corresponds in shape to that of a radially outer portion of each said lacing turn and is substantially trapezoidal.

11. A bobbin as claimed in claim 10 wherein said helical spring has a biasing force of about 2–3 kp, a maximum resilient axial compressibility of about 45% of the length thereof at a total pressure of about 5–7 kp, and a resilient radial compressibility of between 1–20% of the inner diameter thereof.

12. A bobbin as claimed in one of claims 11 or 10 wherein said helical spring is a hardened stainless steel spring of a diameter of 3–5 mm and with a winding distance of 20–30 mm and a spring diameter of 75–80 mm, and wherein said lacing is made of a stainless steel wire of a diameter of 0.8–1.2 mm with a trapezoidal lacing profile of 20–35 turns per helical spring turn and whereby the acute angles of the trapezium are 30°–45°, permitting a radial compression of about 5–8% of the spring diameter or about 4.5–6.4 mm upon an axial compression of about 20%.

13. The bobbin of claim 3 or 4 wherein said outer surface of said slot corresponds in shape to that of a radially outer portion of each said lacing turn and is substantially elliptical.

14. The bobbin of claim 3 or 4 wherein said outer surface of said slot corresponds in shape to that of a radially outer portion of each said lacing turn and is substantially circular.

* * * * *